US005759075A

United States Patent [19]

Steep et al.

[11] Patent Number: 5,759,075

[45] Date of Patent: Jun. 2, 1998

[54] PROPELLER GUARD

[75] Inventors: Donald T. Steep, Anderson; Keith A. Jackson, Redding, both of Calif.

[73] Assignee: PropGuard, Inc., Anderson, Calif.

[21] Appl. No.: 824,763

[22] Filed: Mar. 26, 1997

Related U.S. Application Data

[63] Continuation-in-part of Ser. No. 567,190, Dec. 5, 1995, abandoned.

[51] Int. Cl.[6] ..... B63H 5/16

[52] U.S. Cl. ..... 440/72

[58] Field of Search ..... 440/71–73; 416/247 A

[56] References Cited

U.S. PATENT DOCUMENTS

| | | | |
|---|---|---|---|
| 2,135,162 | 11/1938 | Benson | 440/72 |
| 3,802,377 | 4/1974 | Porter et al. | 440/72 |
| 3,889,624 | 6/1975 | Balius | 440/72 |
| 4,078,516 | 3/1978 | Balius | 440/72 |
| 4,957,459 | 9/1990 | Snyder | 440/72 |
| 5,066,254 | 11/1991 | Bass et al. | 440/72 |
| 5,176,550 | 1/1993 | Hooper | 440/72 |
| 5,205,766 | 4/1993 | Arsenault | 440/72 |

*Primary Examiner*—Stephen Avila
*Attorney, Agent, or Firm*—Bielen, Peterson & Lampe

[57] ABSTRACT

A guard for a marine propeller utilizing a flange found on the lower drive unit or power leg, thereof. The guard includes a cage which at least partially encloses the propeller and a support member for holding the cage to the lower drive unit. A support member includes a bracket having a pair of legs with an intermediate portion between the two legs. The bracket is joined to the cage and fixed to the flange found in the lower drive unit of the marine engine having the marine propeller.

4 Claims, 3 Drawing Sheets

PROPELLER GUARD

CROSS REFERENCES TO RELATED APPLICATIONS

This application is a continuation-in-part of our application, Ser. No. 08/567,190, filed 5 Dec. 1995 of the same title new abandoned.

BACKGROUND OF THE INVENTION

The present invention relates to a novel and useful guard for a marine propeller.

Small marine engines of the inboard and outboard type normally possess a lower drive having a propeller unit which extends outwardly from a marine craft. Unfortunately, such propellers are dangerous in that swimmers and divers, as well as marine life, may come in contact with such propellers when turning. Many types of propeller protectors have been proposed in the past. In general, the prior propeller protectors are difficult to manufacture, install, and maintain in position during use.

For example, U.S. Pat. No. 5,205,766 shows a propeller guard that includes a channel that engages the lower leg or drive unit of the motor and a plurality of side ribs that are attached to the same to protect the propeller.

U.S. Pat. Nos. 3,889,624 and 4,078,516 show propeller guards that are formed in the way of a cage having a clamp-type mounting bracket which extends around the lower drive unit of the motor. The bracket or strap generally rests atop the horizontal cavitation plate.

U.S. Pat. No. 4,957,459 shows a propeller shroud that includes a cage and a retainer structure that extends through openings and the anti-ventilation plate above the propeller.

U.S. No. Pat. 5,176,550 shows an engine propeller blade protector that includes a strap fitting around the lower drive unit of the outboard motor and bolted together at one end. The strap is designed to lie between a pair of plates on the lower drive unit for stability.

U.S. No. Pat. 5,066,254 shows a boat propeller guard that is provided with a pair of clamps or brackets that engage the cavitation plate by means of a bolt between the two brackets.

A propeller guard for an outboard motor unit which overcomes the disadvantages of the prior art devices would be a notable advance in the marine industry.

SUMMARY OF THE INVENTION

In accordance with the present invention a novel and useful guard for a marine propeller is herein provided.

The propeller guard of the present application includes a cage which at least partially encloses the propeller. A support member for holding the cage to the lower drive unit is formed with a bracket, a first leg, and a second leg. The bracket is joined to the first and second legs and wraps around the lower drive unit of the marine engine. The bracket lies atop the flange of the lower drive unit while the legs extend downwardly therefrom.

First connecting means is found for mounting the first and second legs to the cage below the bracket of the support member and to the bracket itself. The first and second legs are connected on either side of the lower drive unit and each form a generally triangular configuration between the cage and the bracket of the support member. The legs connect to the bracket by the use of L-shaped fittings and connectors. In addition, second connecting means is also included for mounting the bracket to the cage. In this position, the cage depends downwardly in a plane which is essentially perpendicular to the bracket of the support member.

Fixing means is also provided in the present invention for holding the bracket to the flange of the lower drive unit. Such fixing means includes at least one clamp which sandwiches the bracket to a portion of the flange of the lower drive unit. In certain instances, a plurality of such clamps are employed along the bracket to achieve this result. Additionally, the fixing means includes an adjustable brace spanning the end portions opposite the U-shaped portion that wraps around the lower drive unit. Thus, the guard of the present invention is held to the lower drive unit in one direction and to the flange of the lower drive unit in another direction, which is essentially perpendicular to the first direction.

The at least one clamp may include a plurality of clamps each having a channel member and a fastener holding the clamp to the flange of the lower drive unit. In addition, each clamp may be provided with a strip of resilient material placed against the flange of the lower drive unit to absorb vibration and shock.

It may be apparent that a novel and useful guard for a propeller of a marine engine has been described above.

It is therefore an object of the present invention to provide a guard for a marine propeller which is reliable and simple to install on the lower drive unit of a marine engine.

Another object of the present invention is to provide a guard for a marine propeller which encloses the propeller to prevent accidents involving persons and animals.

A further object of the present invention is to provide a guard for a marine propeller which includes a fixing structure that does not loosen over time and employs fixation in multiple directions.

Another object of the present invention is to provide a guard for a marine propeller which is easily maintained and resistant to damage by the natural vibration of the marine engine.

The invention possesses other objects and advantages especially as concerns particular characteristics and features thereof which will become apparent as the specification continues.

Figure 1:
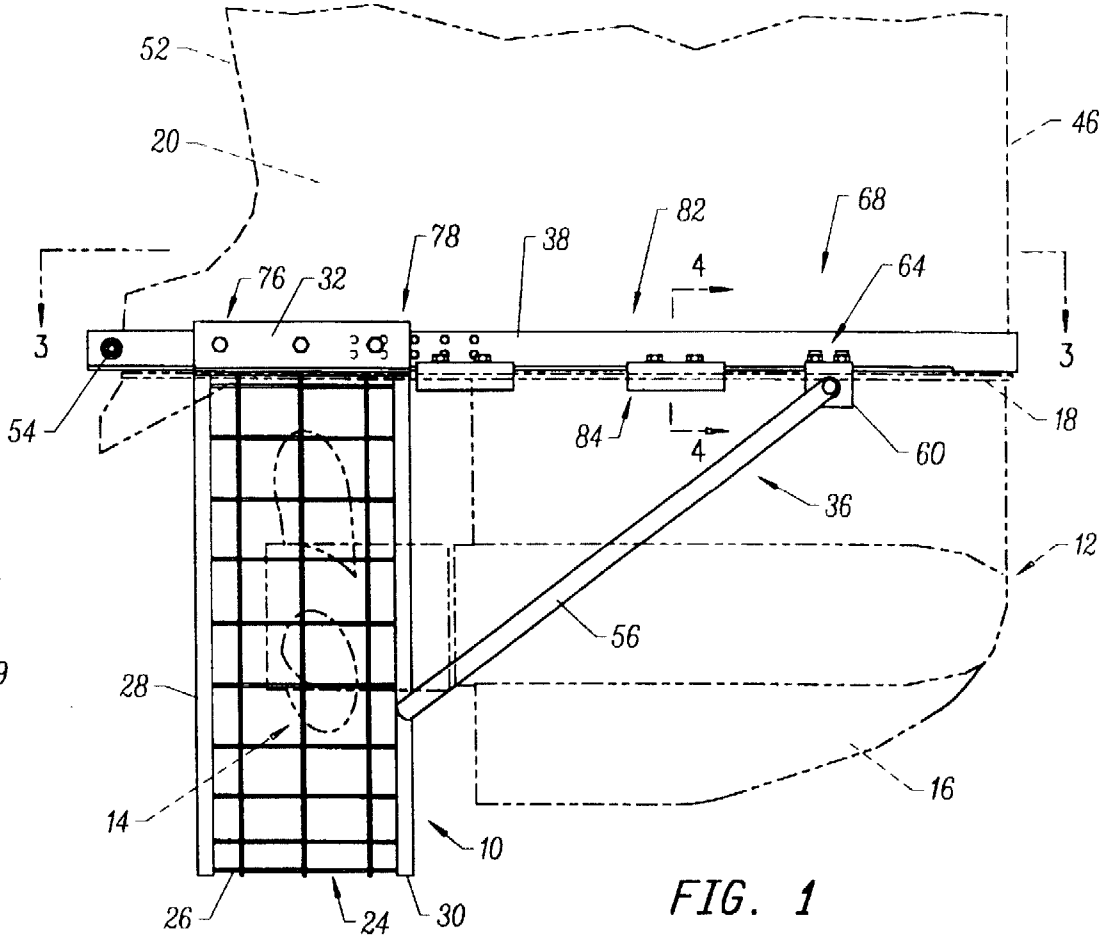
FIG. 1 is a side elevational view of the guard of the present invention installed on a lower drive unit of an outboard unit, depicted in phantom.
Figure 2:
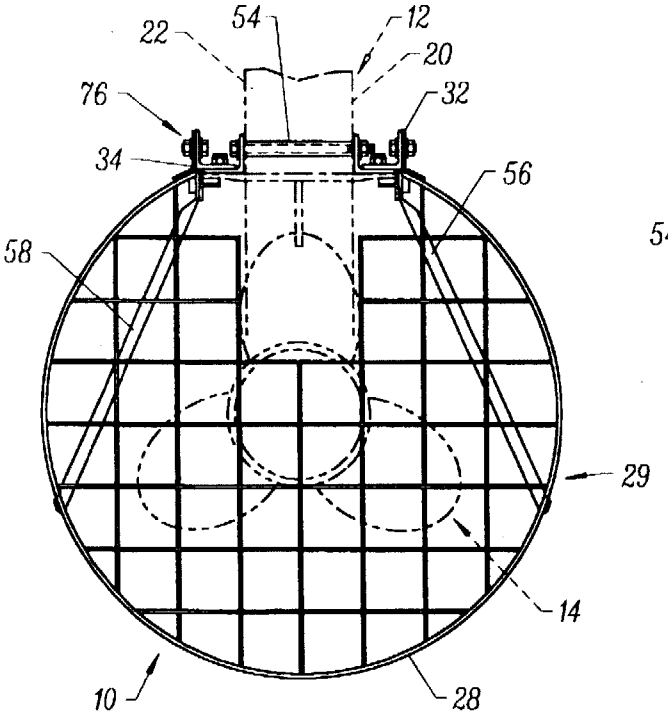
FIG. 2 is a rear elevational view of the guard of the present invention installed on the lower drive unit of a marine engine, depicted in phantom.

For a better understanding of the invention reference is made to the following detailed description of the preferred embodiments thereof which should be taken in conjunction with the hereinbefore described drawings.

DETAILED DESCRIPTION OF THE PREFERRED EMBODIMENTS

Various aspects of the present invention will evolve from the following detailed description of the preferred embodiments thereof which should be referenced to the prior described drawings.

The invention as a whole is depicted in the drawings by reference character 10. Guard 10 is used in conjunction with a lower drive unit 12 of a marine engine. Unit 12 includes a propeller 14 which rotates above skeg 16. Lower drive unit or power leg 12 extends downwardly from an inboard or outboard marine engine (not shown). Propeller 14 and skeg 16 lie beneath a flange or cavitation plate 18. Cavitation plate 18 extends around sides 20 and 22 of lower drive unit 12. In certain marine engines, lower drive units may include a multiplicity of such flanges, similar to cavitation plate 18, which generally lie in parallel planes relative to one another.

Propeller guard 10 includes as one of its elements a cage 24 which at least partially encloses propeller 14. As shown in the drawings, cage 24 is cylindrical in shape and includes a mesh portion 26 between circular rims 28 and 30. Mesh portion 24 and rims 28 and 30 terminate upwardly in a pair of plates 32 and 34.

Figure 3:
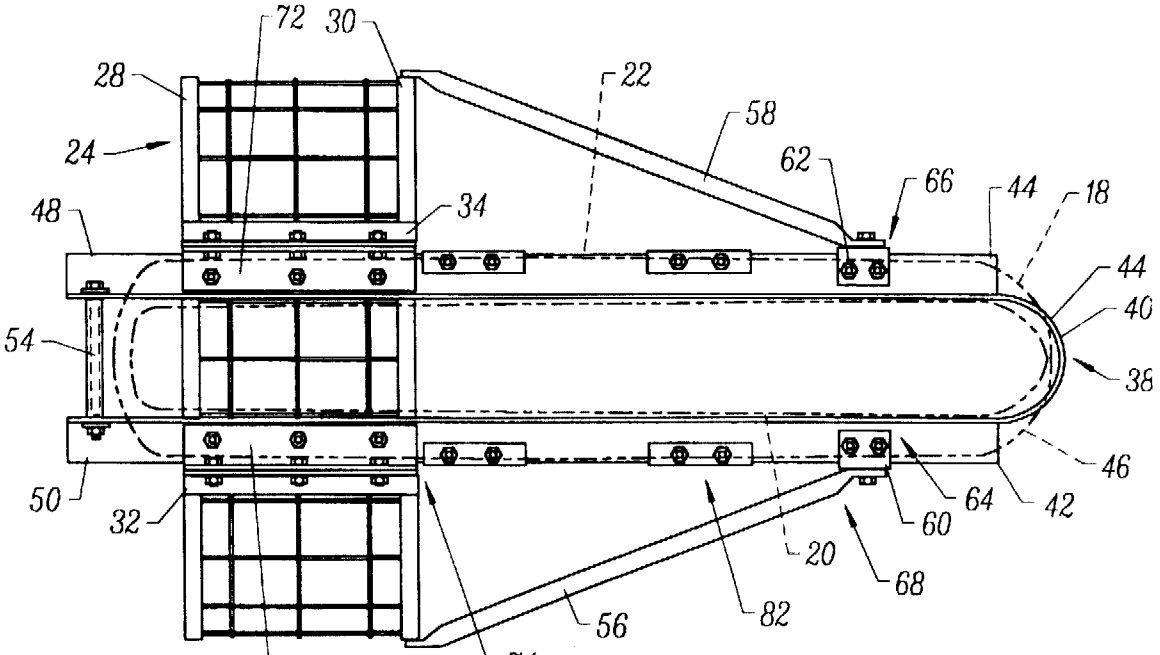
FIG. 3 is a sectional view taken along 3—3 of FIG. 1.
Figure 4:
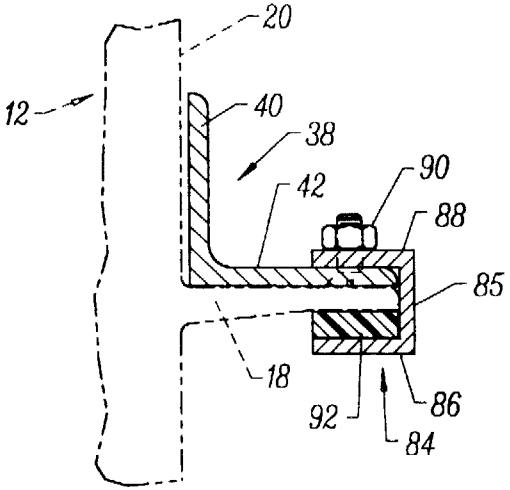
FIG. 4 is a detail of a clamp taken along line 4—4 of FIG. 1.

Support member 36 is also depicted in the drawing for holding cage 24 to lower drive unit 12. Support member includes a bracket or strap 38 which is in the form of a U-shaped member that extends around sides 20 and 22 of lower drive unit 12. Bracket 38 includes a wall portion 40 and a pair of horizontal portions 42 and 44 which extend along sides 20 and 22 of lower drive unit 12. FIG. 4 best depicts the portion of strap or bracket 38 extending along side 20 of lower drive unit 12. Turning to FIG. 3, it may be observed that intermediate portion 44 of bracket 38 curves around lower drive unit leading edge 46. In addition, bracket 38 terminates in ends 48 and 50 at trailing edge 52 of lower drive unit 12. It should be noted that adjustable brace 54 spans ends 48 and 50 of bracket 38. As depicted in the embodiment shown in the drawings, brace 54 takes the form of a threaded nut and bolt which is capable of being tightened to force ends 48 and 50 of bracket 38 together and, consequently to hold wall portion 40 of bracket 38 snugly against lower drive unit 12.

Bracket 38 also includes legs 56 and 58 which extend from rim 30 of cage 24 through a connection which is in the form of a weld. Of course, other connectors may be included or used in this regard to fix legs 56 and 58 to rim 30. L-shaped fittings 60 and 62 connect to legs 56 and 58, respectively. Each L-shaped fitting, in turn, is fixed to horizontal portions 40 and 44 of bracket 38, respectively by plurality of connectors 64 and 66. Thus, legs 56 and 58 form a triangular space between cage 12 and bracket 38 to provide good firm mounting of cage 12. In essence, L-shaped fittings 60 and 62, as well as the welds hereinbefore described serve as first connecting means 68 for mounting the first and second legs 56 and 58 to cage 24 and bracket 38.

With further reference to FIG. 3, it may be observed that L-shaped fittings 70 and 72 fasten to horizontal portions 40 and 42 of bracket 38 by plurality of screws or connectors 74. In addition, plurality of bolts and nuts 76 connect L-shaped fittings 70 and 72 to plates 32 and 34 of cage 24. This interconnection between plates 32 and 34 of cage 24 and L-shaped fittings 70 and 72, respectively, serve as second connection means 78 for mounting bracket 38 to cage 24.

Fixing means 80 is also depicted in the drawings for holding bracket 38 to the flange 18 or cavitation plate of lower unit 12. As heretofore noted, flange 18 may take the form of another plate other than a cavitation plate. Fixing means 80 takes the form of a plurality of clamps 82 which sandwich bracket 38 to flange 18. With reference to exemplary clamp 84, U-shaped member 85 is provided having legs 86 and 88. Leg 88 of U-shaped member 84 lies atop horizontal portion 42 of bracket 38. Screw 90 fastens leg 88 in this position. A strip of resilient material 92 extends between cavitation plate 18 and leg 86. Strip 92 is confined to this position by leg 86, but other fastening means may be employed, such as mastic, set screws, and the like, to additionally fix strip beneath leg 86.

Figure 5:
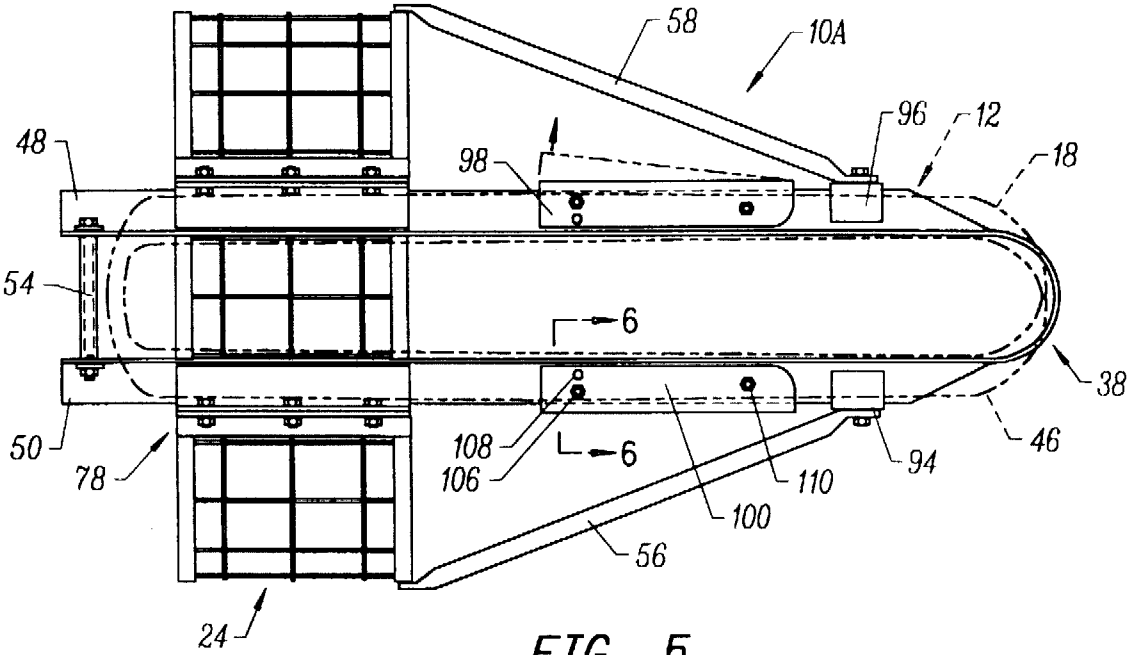
FIG. 5 is a top plan view of another embodiment of the present invention.
Figure 6:
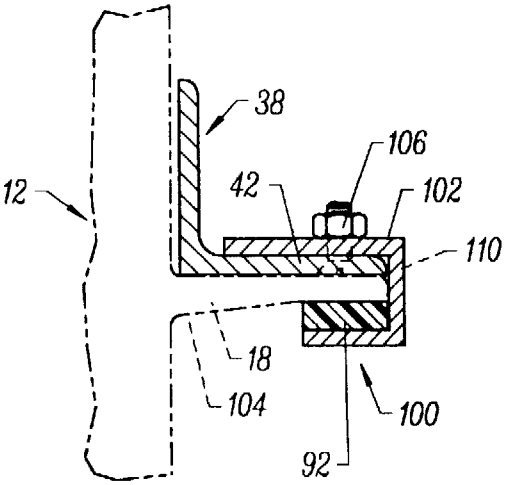
FIG. 6 is a sectional view taken along the line 6—6 of FIG. 5.

Referring now to FIG. 5, it may be observed that another embodiment 10A of the present invention is shown. The guard 10A includes a cage 24 which is held to bracket 38 by the use of connecting means 78, similar to the embodiment depicted in FIGS. 1–4. Brace 54 holds ends 48 and 50 of bracket 38 in place as shown in FIG. 5. Legs 56 and 58 connect to cage 24 and are fastened to cavitation plate flange 18 by the use of U-shaped brackets 94 and 96. In addition, slip sleeves or clamps 98 and 100 are employed along flange 18 to support bracket 38 to cavitation plate 18. According to FIG. 6, it may be observed that exemplary slip sleeve 100 is shown and includes a channel member 102 which fits over base or horizontal portion 42 of bracket 38. A strip 92 of resilient material lies between bracket 102 and the underside 104 of cavitation plate 18. Strip 92 may be formed of any suitable material such as polyethylene plastic, rubber, and the like. Fastener 106 holds channel member 102 in place by a simple friction fit. In other words, no holes are required to be drilled in to cavitation plate 18 for use of the fixing means 107 depicted in FIGS. 5 and 6. In addition, opening 108 is provided in channel member 102 to permit the use of channel member 102 on cavitation plates of different sizes. Further, pivot pin 110 is provided to rotate channel member 102 to an suitable position for eventual use. Again, such rotation mechanism permits the easy use of guard 10A on cavitation plates of various configurations.

In operation, the user attaches guard 10 to lower drive unit 12 of a marine engine. Bracket 38 is fastened around leading edge 46 of lower drive unit 12 such that ends 48 and 50 extend beyond trailing edge 52 of lower drive unit 12. Brace 54 is then attached to hold bracket 38 snugly against sides 20 and 22 of lower drive unit atop cavitation plate 18 thereof. Cage 24 is then placed around propeller 14 and end plates 32 and 34 are fastened to L-shaped brackets 70 and 72 by plurality of bolts and nuts 76. Plurality of connectors 74 hold L-shaped brackets to horizontal portions 42 and 44 of bracket 38, i.e., connecting means 78. Connecting means 68 is then employed to hold legs 56 and 58 to bracket 38 via L-shaped fittings 60 and 62. Finally, fixing means 80 is employed to firmly mount bracket 38 to cavitation flange 18 by way of plurality of clamps 82. Resilient strip 92 is also confined by plurality of clamps 82 to the lower surface of cavitation flange 18. With the embodiment shown in FIGS. 5 and 6, guard 10A is fixed to cavitation plate 18 by the use of slip sleeves or clamps 98 and 100 through a rotation mechanism. The fixing means 107 shown in FIGS. 5 and 6 does not require drilling in the cavitation plate 18 and is adaptable to cavitation plates of various configurations. It has been found that guards 10 and 10A do not vibrate or loosen during use and serves as a very efficient propeller guard requiring very little maintenance and repair.

While in the foregoing, embodiments of the present invention have been set forth in considerable detail for the purposes of making a complete disclosure of the invention, it may be apparent to those of skill in the art that numerous changes may be made in such details without departing from the spirit and principles of the invention.

What is claimed is:

1. A guard for a marine propeller of a lower drive unit of a marine engine, the lower drive unit also including a flange; comprising:

a. a cage at least partially enclosing the propeller;

b. a support member for holding said cage to the lower drive unit, said support means including a bracket, a first leg extend along one side of the lower drive unit, and a second leg extend along another side of the lower drive unit, said first and second legs being joined to said bracket;

c. first connecting means for mounting said first and second legs to said cage and said bracket;

d. second connecting means for mounting said bracket to said cage; and e. fixing means intended for holding said bracket to the flange of the lower drive unit, said fixing means including at least one clamp sandwiching said bracket to a portion of the flange of the lower drive unit extending along said first and second legs of said support member, said clamps further including a channel rotatably connected to said bracket, said channel member including a first plate and a second plate, said first plate overlapping said bracket and the flange, second plate overlapping the flange, and a fastener for holding said clamps to the flanges of the lower drive unit.

2. The guard of claim 1 in which said fixing means further includes a plurality of clamps holding sandwiching said bracket to the flange of the lower device unit.

3. The guard of claim 2 in which said clamp further includes a strip of resilient material placed between the flange of the lower drive unit and said second plate of said channel member.

4. The guard of claim 1 in which said bracket includes a first portion extending along the one side of the lower drive unit, a second portion extending along another side of the lower drive unit, and an intermediate portion between said first and second portions, and a brace adjustably connecting said first and second portions of said bracket between the one and another side of the lower drive unit.

* * * * *